US005277421A

United States Patent [19]

Rewolinski

[11] Patent Number: 5,277,421

[45] Date of Patent: Jan. 11, 1994

[54] WEIGHTED PRACTICE BAT

[76] Inventor: John Rewolinski, 3247 S. 81st St., Milwaukee, Wis. 53219

[21] Appl. No.: 52,957

[22] Filed: Apr. 23, 1993

[51] Int. Cl.[5] ..... A63B 69/40

[52] U.S. Cl. ..... 273/26 B; 273/29 A; 273/194 B

[58] Field of Search ..... 273/26 R, 29 A, 186 A, 193 R, 193 A, 194 B, 26 B, 72 R

[56] References Cited

U.S. PATENT DOCUMENTS

| | | | |
|---|---|---|---|
| 1,026,990 | 5/1912 | Matson | 273/72 R |
| 1,499,128 | 6/1924 | Shroyer, Jr. | 273/72 R |
| 1,665,195 | 4/1928 | Cohn | 273/72 R |
| 3,116,926 | 1/1964 | Owen et al. . | |
| 3,136,546 | 6/1964 | Connolly . | |
| 3,137,504 | 6/1964 | Zordan | 273/72 R |
| 3,173,688 | 3/1965 | Green | 273/72 R |
| 3,246,894 | 4/1966 | Salisbury . | |
| 3,508,748 | 4/1970 | Strimel . | |
| 3,521,883 | 7/1970 | Hamilton . | |
| 3,578,801 | 5/1971 | Piazza . | |
| 3,623,724 | 11/1971 | Lande . | |
| 3,716,239 | 2/1973 | Goudreau . | |
| 3,955,816 | 5/1976 | Bratt . | |
| 4,260,150 | 4/1981 | Tabet . | |
| 4,330,121 | 5/1982 | McCafferty . | |
| 4,555,111 | 11/1985 | Alvarez . | |
| 4,634,121 | 1/1987 | Sasaki . | |
| 4,671,508 | 6/1987 | Tetreault . | |
| 4,763,899 | 8/1988 | Hundley . | |
| 4,819,935 | 4/1989 | Dirksing et al. . | |
| 4,871,168 | 10/1989 | Autorino . | |
| 4,898,384 | 2/1990 | Beach . | |
| 4,898,386 | 2/1990 | Anderson | 273/72 R |
| 4,907,800 | 3/1990 | Passamaneck et al. . | |
| 5,024,436 | 6/1991 | Vento . | |
| 5,050,877 | 9/1991 | Wales . | |
| 5,133,551 | 7/1992 | Handy | 273/26 B |

*Primary Examiner*—Theatrice Brown

*Attorney, Agent, or Firm*—Andrus, Sceales, Starke & Sawall

[57] ABSTRACT

An elongated baseball bat includes an integral handle and barrel portion and a separate end portion that is threadedly attached to the barrel portion by means of a threaded stem that extends from the barrel portion. A plurality of cylindrical weights are slidably mounted over the threaded stem and are disposed within an axial cavity in the end portion as the end portion is rotated onto the threaded stem.

7 Claims, 1 Drawing Sheet

WEIGHTED PRACTICE BAT

BACKGROUND OF THE INVENTION

The present invention relates to an exercise or warm-up device and more specifically to a weighted baseball bat.

In the past, a variety of exercise or warm-up devices have been provided for use by baseball players. Persons who play baseball, softball, and similar sports, often use various devices and methods to improve their batting skills. For example, players may utilize a plurality of bats, a single bat with weighted collars or clamps and the like attached thereto, permanently weighted bats (e.g. hollowed out bats with solid or flowable weight materials included therewithin), or a bat with attached vanes or the like to effect aerodynamic drag. Such devices and methods are employed to facilitate general warming-up, stretching muscles, and developing the muscles used for batting, as well as to improve a player's bat speed, reaction skill, bat control, and the like. Swinging a plurality of bats can be awkward, and there is a limit as to how many bats a person can swing safely and/or comfortably.

Baseball is also a sport steeped in tradition and ball players at every level prefer a warm-up or exercise device that looks and feels like a traditional bat.

A weighted collar for a bat is disclosed in U.S. Pat. No. 3,521,883, which issued to F. Hamilton on Nov. 27, 1967. The Hamilton collar comprises a rigid ring-like member adapted to slide over the handle of a bat and create an interference fit with the larger end thereof. Centrifugal force acts to hold the ring-like member in place as the bat is swung. A more complex collar is disclosed in U.S. Pat. No. 4,260,150, which issued to M. Tabet on Aug. 17, 1979. The Tabet collar comprises a resilient member disposed between two rigid members. The two rigid members serve to provide the weight to the device and to encapsulate the resilient member which serves to frictionally engage the bat. Such devices have, however, been found to be unsafe as they can become dislodged during swinging. Additionally, these devices are not adjustable because the position of the collar on the bat is generally predetermined by the interference of the inside diameter of the collar with the outside diameter of the barrel of the bat.

A weighted clamp for a bat is also disclosed in U.S. Pat. No. 3,834,697, which issued to J. McNamara on May 14, 1973. The McNamara device is similar in principle to the Hamilton and Tabet collars (e.g. supplemental weight added to a bat); however, the McNamara device is attached by clamping action instead of simple interference fit. Additionally, while its position along the bat is adjustable, the McNamara weighted clamp can also become dislodged during swinging.

A fixed or permanently weighted bat is disclosed in U.S. Pat. No. 3,246,894, which issued to L. Bratt on Mar. 11, 1974. The Bratt device includes sand ballast contained within the upper portion of its barrel. In order to change the weight of the Bratt bat, one must disassemble the barrel portion of the bat and add or remove sand or other flowable ballast.

U.S. Pat. No. 4,819,935 to Dirksing et al discloses a weighted bat in which the weight may be positioned along a threaded axial member. The weight must be rotated on and off the member and when in use, the bat does not have the appearance of a typical baseball bat.

Training devices that include vanes or the like to effect aerodynamic drag during swinging exercises are disclosed in U.S. Pat. No. 3,809,397, which issued to B. Gruenewald on Apr. 3, 1972, and U.S. Pat. No. 4,330,121, which issued to J. McCafferty on Oct. 2, 1980. With such devices attached to the barrel of the bat, the batter experiences a resistance to the swinging motion as the vanes "push" through the air. The amount of resistance experienced by the batter is proportional to the angular velocity with which the bat is moved. Therefore, a batter must swing the bat faster to simulate additional bat weight, a requirement not always compatible with effective training or warm-up procedures.

As described above, despite all of the prior work done in this area, there remain problems of safety, adjustability, convenience and traditional look and feel in incorporating weighted devices into training devices.

SUMMARY OF THE INVENTION

A weighted practice bat includes an elongated baseball bat having an integral handle and barrel portion and a separate end portion. The handle, barrel and end portions conform substantially to the standard size, shape and characteristics of a baseball bat.

In accordance with one aspect of the invention, a threaded attachment stem is fixedly attached and extends from the barrel portion of the bat.

In accordance with another aspect of the invention, a threaded sleeve is fixedly mounted in an axial cavity in the end portion of the bat so that the end portion may be threadedly attached to the handle and barrel portion.

In accordance with yet another aspect of the invention, a plurality of weighted attachments are slidably mounted over the attachment stem and have a diameter less than that of the axial cavity and a length equal to that of the cavity.

In accordance with still another aspect of the invention, the weight attachements are disposed within the end portion when the end portion is connected to the barrel portion.

The present invention thus provides a weighted practice bat that looks and feels substantially identical to an actual baseball bat and one in which the size of the weights may be easily varied and still provide a high degree of safety when in use.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENT

Figure 1:
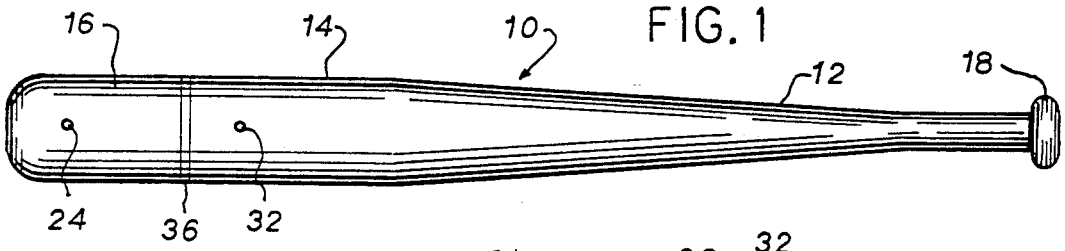
FIG. 1 is a side view of a practice bat constructed according to the present invention.
Figure 2:
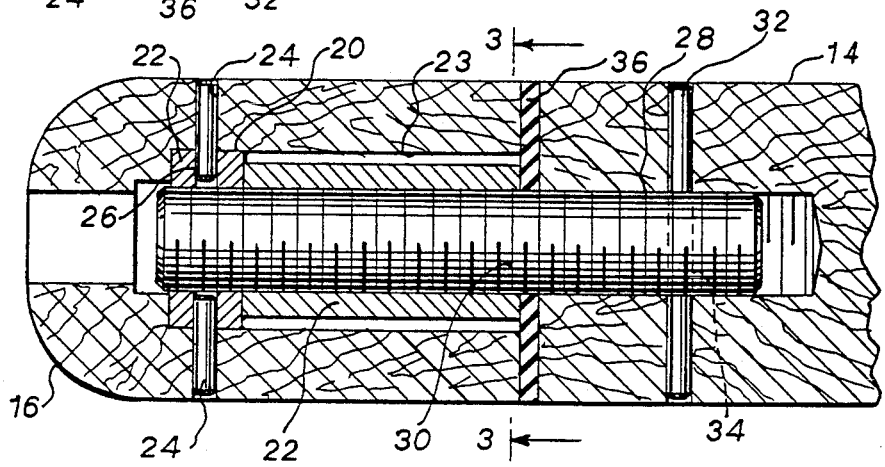
FIG. 2 is a side cross-sectional view of the connection between the end portion of the bat and the barrel portion of the bat of FIG. 1.

As shown in FIG. 1, a weighted practice bat 10 includes an integral handle portion 12 and barrel portion 14 and a separate end portion 16. Handle portion 12 is provided with the typical end knob 18 and handle portion 12, barrel portion 14 and end portion 16 are dimensioned so as to conform substantially to the standard size and shape characteristics of a baseball bat. In fact, it is suggested that weighted baseball bat 10 be manufactured from a traditional ball bat.

In order to manufacture weighted practice bat 10, end portion 16 is sawed off of a metal or wooden bat. End portion 16 is then provided with an axial cavity 20 in which a threaded sleeve 22 is disposed. Threaded sleeve 22 is held in position in cavity 20 by a pair of pins 24 that extend radially through end portion 16 and into a pair of radial recesses 26 located in the outer end of sleeve 22. Once threaded sleeve 22 is positioned in axial cavity 20, a remaining cavity portion 23 exists.

Barrel 14 is provided with a threaded axial cavity 28 in which elongated threaded attachment stem 30 is disposed. Attachment stem 30 is held within cavity 28 by a locking pin 32 that extends through bat barrel 14 and through an aperture 34 in threaded stem 30. Threaded stem 30 extends outwardly from cavity 28 so that end portion 16 may be threadedly attached to barrel portion 14.

Barrel portion 14 is also provided with a resilient gasket 36 that surrounds attachment stem 30 and allows bat end 16 to be tightened securely to barrel portion 14.

Figure 4:
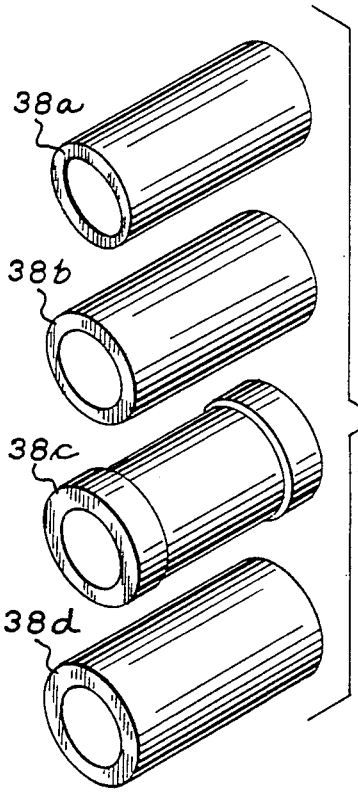
FIG. 4 is a perspective view of a plurality of weighted cylinders that can be utilized with the bat of FIG. 1.
Figure 3:
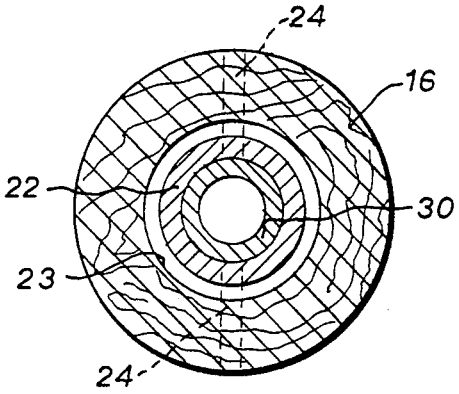
FIG. 3 is a sectional view along the line 3—3 of FIG. 2.

As seen in FIG. 4, a plurality of weight attachments 38*a*–38*d* in the form of weighted cylinders are provided for use with practice bat 10. Cylinders 38*a*–38*d* vary in weight and have an outer diameter less than that of cavity 20 and a length equal to that of cavity portion 23 so that when a weighted cylinder 38 is slid over stem 30, end portion 16 may be rotated onto stem 30 and cylinder 38 will be disposed completely within cavity portion 23, thus retaining the appearance of a regular bat.

The present invention thus provides a weighted practice bat in which both the size and position of the weight may be easily adjusted and whose appearance substantially conforms to that of an ordinary baseball bat.

Various modes of carrying out the invention are contemplated as being within the scope of the following claims particularly pointing out and distinctly claiming the subject matter regarded as the invention.

I claim:

1. A weighted practice bat comprising:

an elongated baseball bat having an integral handle and barrel portion and a separate end portion, said handle, barrel and end conforming substantially to the standard size and shape characteristics of a baseball bat, a threaded attachment stem extending axially from said barrel portion said end portion having a weight receiving cavity having a threaded member therein whereby said end portion may be threadedly attached to said stem and barrel portion and a plurality of weight attachments having circular cross sections and a central opening so that one of said attachments may be slidably disposed over said attachment stem and having a diameter less than that of said weight receiving cavity, said weight attachments being slidably mounted on said attachment stem and disposed completely within said weight receiving cavity when said barrel and end portions are connected.

2. The practice bat of claim 1 wherein said attachment stem is fixedly attached to and extends from an axial cavity in said barrel portion.

3. The practice bat of claim 2 wherein said threaded member is a sleeve fixedly mounted in said weight receiving cavity in said end portion.

4. The practice bat of claim 1 further comprising a resilient gasket disposed between said barrel portion and said end portion.

5. The practice bat of claim 4 wherein said gasket surrounds said attachment stem and is fixedly attached to said barrel portion.

6. The practice bat of claim 1 wherein said weight attachments have a plurality of weights.

7. A weighted practice bat comprising:

an elongated baseball bat having an integral handle and barrel portion and a separate end portion, said handle, barrel and end conforming substantially to the standard size and shape characteristics of a baseball bat, a threaded attachment stem fixedly attached to and extending from an axial cavity in said barrel portion, a threaded sleeve fixedly mounted in an axial weight receiving cavity in said end portion whereby said end portion may be threadedly attached to said stem and a plurality of weighted cylinders having an outer diameter less than that of said weight receiving cavity and a length substantially equal to that of said cavity so that one of said cylinders may be slidably mounted on said attachment stem and disposed completely within said weight receiving cavity when said end portion is connected to said barrel portion.

* * * * *